United States Patent [19]

Taylor

[11] Patent Number: 4,526,280

[45] Date of Patent: Jul. 2, 1985

[54] BOTTLE COVER

[76] Inventor: Sharon E. Taylor, 604 W. Market St., Germantown, Ohio 45327

[21] Appl. No.: 639,753

[22] Filed: Aug. 13, 1984

[51] Int. Cl.[3] ..... B65D 65/10; B65D 23/08; A47G 23/02

[52] U.S. Cl. ..... 215/100.5; 215/12 R; 150/52 R

[58] Field of Search ..... 150/52 R; 206/260; 215/12 R, 12 A, 13 R, 100.5, 100 R; 383/2; 224/148, 901; 220/85 H, 89

[56] References Cited

U.S. PATENT DOCUMENTS

| | | | |
|---|---|---|---|
| 2,035,384 | 3/1936 | Hinchliff | 150/52 R |
| 2,927,617 | 3/1960 | Kurzrock | 383/2 |
| 2,974,814 | 3/1961 | Parsons et al. | 215/13 R |
| 4,180,111 | 12/1979 | Davis | 383/2 |
| 4,282,279 | 8/1981 | Strickland | 150/52 R |
| 4,293,015 | 10/1981 | McGough | 150/52 R |
| 4,340,146 | 7/1982 | Stratton | 215/100.5 |
| 4,401,245 | 8/1983 | Zills | 215/12 A X |

FOREIGN PATENT DOCUMENTS

| | | | |
|---|---|---|---|
| 112972 | 4/1941 | Australia | 215/12 R |

*Primary Examiner*—William Price
*Assistant Examiner*—Sue A. Weaver
*Attorney, Agent, or Firm*—Biebel, French & Nauman

[57] ABSTRACT

A cover of adjustable size for a bottle and a package comprising a bottle received by such a cover. The bottle cover is fabricated from absorbent cloth material and has patches of hook and loop fastening material attached to the outer surface thereof. The cover is in the form of a pouch having a cavity which is larger than the bottle to be received. Afer insertion of a bottle into the cavity, a flap of excess pouch material is folded around the bottle and secured in place by means of the hook and loop patches.

12 Claims, 4 Drawing Figures

BOTTLE COVER

BACKGROUND OF THE INVENTION

This invention relates to covers for bottles of the type commonly used for products such as baby oil, suntan or body lotion or food products, such as ketchup or cooking oil. When such bottles are put to normal use the contents become smeared on the outside surface thereof, thereby making them slippery and difficult to handle. This creates an additional problem when such bottles are used on a sandy beach and accumulate surface coverings of sand or other foreign substances. Additionally, sticky and/or greasy bottles will soil kitchen cabinet and refrigerator surfaces.

SUMMARY OF THE INVENTION

This invention provides an absorbant cloth bottle cover in the form of a pouch which may be folded to define a bottle holding cavity of adjustable size. Strips of interlocking hook and loop fastening material are secured to the surface of the pouch in an arrangement such that a flap of excess material may be folded conformably about the bottle and thereafter secured in place.

Accordingly, it is an object of the invention to provide an absorbent bottle cover of adjustable size.

It is another object of the invention to provide a package comprising a bottle received within an adjustably conforming cloth pouch.

Other objects and advantages of the invention will be apparent from the following description, the accompanying drawings and the appended claims.

DESCRIPTION OF THE PREFERRED EMBODIMENT

Figure 1:
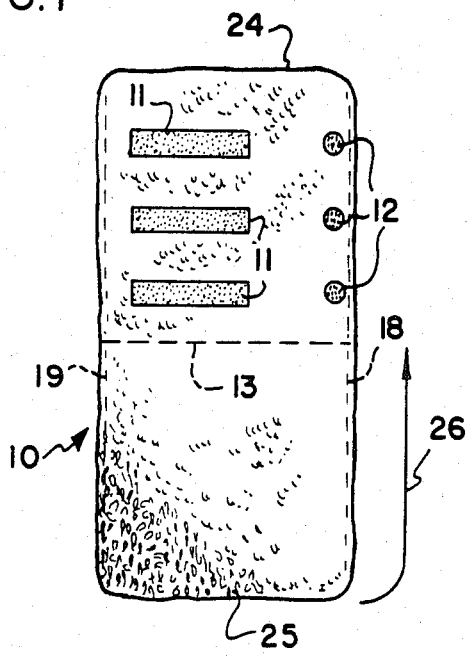
FIG. 1 illustrates a pouch blank with patches of hook and loop fastening material secured to the surface thereof.

FIG. 1 illustrates a blank 10 for fabrication of a pouch in accordance with the present invention. Blank 10 may be made of an absorbent cloth material, such as a material commonly known as terrycloth. Such cloth readily absorbs oily or sticky material of the type that often collects on the surface of bottles when they are normally used.

As further illustrated in FIG. 1 a plurality of first and second patches of hook and loop fastening material 11 and 12 may be sewn, adhesively secured or otherwise affixed to a common surface of blank 10. These patches may be fashioned from a fabric of the type sold by Velcro U.S.A. of New York, N.Y. under the trademark VELCRO. Patches 11 are preferably of generally rectangular configuration mounted with their major axes parallel to the upper edge 24 of blank 10. As will be apparent from the following description, top edge 24 and the opposing bottom edge 25 of blank 10 cooperatively define an open side of a fully completed pouch. First patches 11 are spaced at different distances from edge 24 and are equidistant from opposing second patches 12 positioned for interlocking engagement therewith. This requires that hook-type fabric be used for one patch in each mating pair while loop-type fabric is used for the other.

Also illustrated in FIG. 1 are a pair of stitch lines 18 and 19, along which a thread will be stitched during subsequent fabrication steps. FIG. 1 additionally illustrates a fold line 13. A fully fabricated pouch 14 is illustrated in FIG. 2.

Pouch 14 is fashioned by folding the lower portion of blank 10 upwardly and outwardly as indicated by the arrow 26 to create a fold line as indicated by the reference numeral 13. Thereafter, the folded blank is stitched along the lines 18 and 19 to create a pouch having patches 11 and 12 on the inside surface. The pouch is then turned inside out to produce a configuration as illustrated in FIG. 2.

Figure 2:
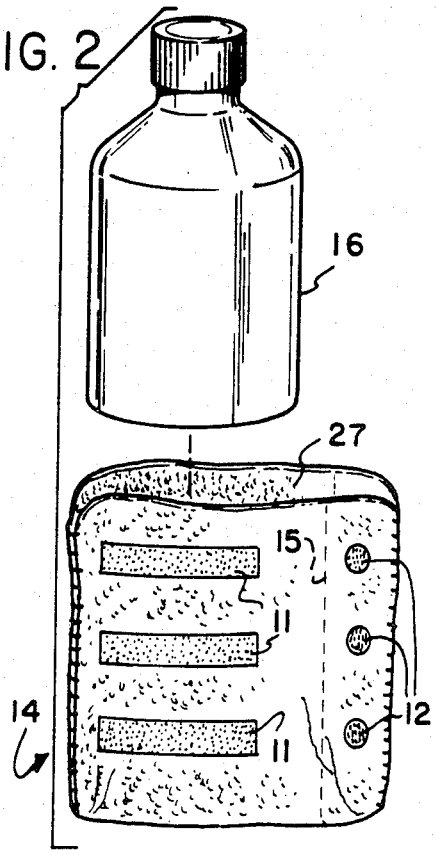
FIG. 2 is an illustration of a pouch produced from a blank configured in accordance with FIG. 1 with a bottle to be inserted therein.
Figure 3:
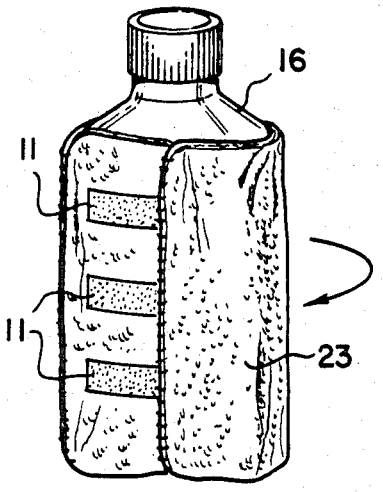
FIG. 3 is an illustration of a package comprising the bottle and pouch illustrated in FIG. 2.

A pouch 14, as illustrated in FIG. 2 has a cavity 26 which is more than large enough to receive a bottle 16. The cavity 27 is sufficiently large to enable reception of the bottle 16 and subsequent folding along a line generally perpendicular to the open side of the pouch. (See the dotted line 15 of FIG. 2). This defines a flap of excess material 23 as illustrated in FIG. 3. When the flap 23 is folded over the bottle enclosing portion of the pouch, as illustrated in FIG. 3, the second patches of fastening material 12 overlie the first patches 11 and become engaged therewith. This creates a snug, secure package.

Figure 4:
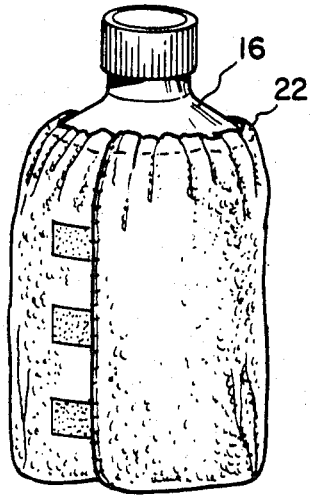
FIG. 4 is an illustration of a package comprising a bottle and a pouch of an alternative embodiment.

In an alternative embodiment, as illustrated in FIG. 4, a strip of elastic material or a drawstring 22 may be attached to those edges of pouch 14 defining the open sides thereof. This causes the pouch to contract along the upper edge and better confine the bottle 16.

In the preferred embodiment, as above described, the first patches of fastening material 11 are shaped to have a generally elongated rectangular configuration, whereas the second patch 12 are somehwat smaller in size. Preferably, second patches 12 have a major dimension approximately equal to the minor dimension of patches 11. Patches 12 conveniently may have a circular configuration.

It will be apparent that the blank 10 need not have the precise configuration shown in FIG. 1. For example, the material illustrated in FIG. 1 as being below the fold line 13 may be positioned either to the right of the patches 12 or to the left of the patches 11, so that the completed pouch has a fold line adjacent to the open side and a seam along the side opposite the open side. Alternatively, the pouch may be fabricated from two entirely separate blanks of material which are stitched along three sides.

While the forms of covers and packages herein described constitute preferred embodiments of the invention, it is to be understood that the invention is not limited to these precise forms, and that changes may be made therein without departing from the scope of the invention which is defined in the appended claims.

What is claimed is:

1. A bottle cover comprising:

an absorbent cloth pouch which is open on one side for reception of a bottle, a first patch of hook and loop fastening material attached to the outer surface of said pouch, and a second patch of hook and loop fastening material attached to the outer surface of said pouch in spaced relation to said first patch such that said pouch may be folded along a line generally perpendicular to said open side for confining a container therein;

said first and second patches of hook and loop material being mutually fastenable.

2. A bottle cover according to claim 1 wherein said pouch has a generally rectangular configuration when flattened.

3. A bottle cover comprising:

an absorbent cloth pouch of generally rectangular configuration having three closed sides and one open side, a plurality of first patches of hook and loop fastening materials of generally rectangular configuration secured to one face of said pouch with their major axes parallel to said open side and spaced at different distances therefrom, and a plurality of second patches of hook and loop fastening material secured to said one face at equidistant spaces from said first patches;

said second patches being positioned at different distances from said open side for engagement with said first patches and being configured for interlocking engagement therewith.

4. A bottle cover according to claim 3 wherein two of said three closed sides are defined by stitch lines and one closed side is defined by a fold line.

5. A bottle cover according to claim 4 wheren said second patches have major dimensions approximately equal to the minor dimensions of their mating first patches.

6. A bottle cover according to claim 5 wherein said fold line defines that side of said pouch which is remote from said open side.

7. A bottle cover according to claim 6 wherein said second patches have a generally circular configuration.

8. A bottle cover according to claim 3 further comprising a strip of elastic material secured to said pouch along the edge defining said open side.

9. A bottle cover according to claim 3 further comprising a drawstring secured to said pouch along the edge defining said open side.

10. A package comprising:

an absorbent cloth pouch of generally rectangular configuration which is closed on three sides and open on one side and which is folded along a line perpendicular to said open side to create a flap of excess material for adjusting the size of the cavity defined by said pouch, a bottle fittingly inserted into said cavity, and a plurality of patches of hook and loop fastening material secured to the surface of said pouch for retaining said flap and maintaining said pouch in conformance about said bottle.

11. A package according to claim 10 and further comprising a strip of elastic material secured to said pouch along the edge defining said open side for confining said bottle within said cavity.

12. A package according to claim 10 and further comprising a drawstring secured to said pouch along the edge defining said open side for confining said bottle within said cavity.

* * * * *